US009059544B2

(12) United States Patent
Song

(10) Patent No.: US 9,059,544 B2
(45) Date of Patent: Jun. 16, 2015

(54) ELECTRICAL CONNECTOR

(71) Applicant: Molex Incorporated, Lisle, IL (US)

(72) Inventor: Xiao Jun Song, Shanghai (CN)

(73) Assignee: Molex Incorporated, Lisle, IL (US)

( * ) Notice: Subject to any disclaimer, the term of this patent is extended or adjusted under 35 U.S.C. 154(b) by 132 days.

(21) Appl. No.: 13/963,133

(22) Filed: Aug. 9, 2013

(65) Prior Publication Data

US 2014/0051284 A1 Feb. 20, 2014

(30) Foreign Application Priority Data

Aug. 14, 2012 (CN) ..... 2012 2 0401958 U

(51) Int. Cl.

| | |
|---|---|
| ***H01R 33/00*** | (2006.01) |
| ***H01R 12/70*** | (2011.01) |
| ***H01R 12/71*** | (2011.01) |
| ***H01R 13/41*** | (2006.01) |

(52) U.S. Cl.

CPC ..... *H01R 12/7082* (2013.01); *H01R 12/712* (2013.01); *H01R 13/41* (2013.01); *H01R 2201/12* (2013.01)

(58) Field of Classification Search

CPC ... H01H 85/202; H05K 3/301; H05K 3/3426; H01R 13/2442; H01R 23/725; H01R 43/0256; H01R 9/091; H01R 12/57

USPC ..... 439/698, 830, 500, 68, 83

See application file for complete search history.

(56) References Cited

U.S. PATENT DOCUMENTS

| | | | | | |
|---|---|---|---|---|---|
| 1,641,513 | A | * | 9/1927 | Warren | 361/310 |
| 2,352,576 | A | * | 6/1944 | Triplett | 429/100 |
| 3,392,365 | A | * | 7/1968 | Wuennemann et al. | 439/500 |
| 3,629,793 | A | * | 12/1971 | Ettischer et al. | 439/144 |
| 3,993,395 | A | * | 11/1976 | Taylor | 439/698 |
| 4,082,408 | A | * | 4/1978 | Angelis | 439/698 |
| 4,586,777 | A | * | 5/1986 | Wied | 439/358 |
| 4,606,590 | A | * | 8/1986 | Kauffmann et al. | 439/218 |
| 4,607,904 | A | * | 8/1986 | D'Alessandro et al. | 439/476.1 |
| 4,699,445 | A | * | 10/1987 | Porta et al. | 439/698 |
| 4,872,262 | A | * | 10/1989 | Marach | 29/884 |
| 4,938,708 | A | * | 7/1990 | Vigneau et al. | 439/239 |
| 4,938,709 | A | * | 7/1990 | Smith et al. | 439/239 |
| 4,995,819 | A | * | 2/1991 | Ohl | 439/79 |
| 5,007,844 | A | * | 4/1991 | Mason et al. | 439/68 |
| 5,108,314 | A | * | 4/1992 | Takano et al. | 439/620.34 |
| 5,186,652 | A | * | 2/1993 | Hai-Yung | 439/500 |
| 5,288,249 | A | * | 2/1994 | Fitzgerald | 439/612 |
| 5,395,263 | A | * | 3/1995 | Sandell | 439/500 |
| 5,484,297 | A | * | 1/1996 | Takahashi et al. | 439/157 |
| 5,586,891 | A | * | 12/1996 | Kelly et al. | 439/71 |
| 5,590,058 | A | * | 12/1996 | Foreman et al. | 702/63 |

(Continued)

*Primary Examiner* — Abdullah Riyami

*Assistant Examiner* — Vladimir Imas

(74) *Attorney, Agent, or Firm* — Stephen L. Sheldon

(57) ABSTRACT

An electrical connector includes a housing, a pair of terminals and two first conductive traces. The housing comprises two fixing grooves that support the terminals. Each terminal comprises a base, an extending piece extending from the base and a resilient arm extending from the base. The extending piece comprises a first contact portion and the resilient arm comprises a second contact portion for electrically connecting an electronic device. The two first conductive traces are connected to the pair of terminals, an end portion of the each first conductive trace is electrically connected to the first contact portion of the corresponding terminal, and the other end portion of the each first conductive trace is configured to electrically connect to a circuit board.

12 Claims, 8 Drawing Sheets

(56) References Cited

U.S. PATENT DOCUMENTS

| | | | | |
|---|---|---|---|---|
| 5,736,271 | A * | 4/1998 | Cisar et al. | 429/96 |
| 5,808,859 | A * | 9/1998 | Liang | 361/673 |
| 5,957,731 | A * | 9/1999 | Nishihara et al. | 439/698 |
| 6,007,351 | A * | 12/1999 | Gabrisko et al. | 439/76.2 |
| 6,149,470 | A * | 11/2000 | Northey et al. | 439/698 |
| 6,231,370 | B1 * | 5/2001 | Morin et al. | 439/366 |
| 6,375,494 | B2 * | 4/2002 | Renmark et al. | 439/500 |
| 6,530,804 | B1 * | 3/2003 | Wu | 439/500 |
| 6,579,119 | B1 * | 6/2003 | Wu | 439/500 |
| 6,623,293 | B1 * | 9/2003 | Wu | 439/500 |
| 6,634,891 | B1 * | 10/2003 | Cheng | 439/68 |
| 6,692,315 | B1 * | 2/2004 | Soumillon et al. | 439/830 |
| 6,762,375 | B2 * | 7/2004 | Haussmann | 200/52 R |
| 6,843,690 | B2 | 1/2005 | Sauer et al. | |
| 7,530,850 | B2 * | 5/2009 | Maguire et al. | 439/620.28 |
| 7,564,337 | B2 * | 7/2009 | Whitney et al. | 337/268 |
| 7,575,487 | B2 * | 8/2009 | Yodogawa | 439/830 |
| 7,710,236 | B2 * | 5/2010 | Jozwiak | 337/187 |
| 7,782,010 | B2 | 8/2010 | Heerlein et al. | |

* cited by examiner

ELECTRICAL CONNECTOR

RELATED APPLICATIONS

This application claims priority to Chinese Application No. 201220401958.8, filed Aug. 14, 2012, which is incorporated herein by reference in its entirety.

FIELD OF THE PRESENT APPLICATION

The present application relates to an electrical connector, more specifically to a connector that can be used in a hearing aid application.

BACKGROUND OF THE PRESENT APPLICATION

A hearing device is generally powered by a battery, and the battery is generally connected to a circuit board of the hearing device via a battery connector. FIG. 1 illustrates a prior art battery connector 1, as disclosed by U.S. Pat. No. 7,782,010. The battery connector 1 has a housing 11 and two terminals 12, 13. The two terminals 12, 13 are embedded in the housing 11, an end portion of the each terminal 12 or terminal 13 extends out from a bottom face of the housing 11 and forms a soldering portion; the other end portion of the each terminal 12 or terminal 13 extends out from a side face of the housing 11 near a top face of the housing 11 to form an arm portion bent forwardly. The soldering portion may be soldered on the circuit board, and the arm portion may clamp and be electrically connected to the battery.

As shown in FIG. 1, the terminal 12 or terminal 13 extends from the bottom face of the housing 11 into the housing 11, and then extends out from the side face of the housing 11 near the top face of the housing 11, finally is bent forwardly to form the extended arm portion. This extending manner makes the terminal 12 or terminal 13 too long and requires repeated bending for the terminal 12 or terminal 13 several times. Manufacturing of the too long and serpentine terminal 12 or terminal 13 will take more time and labor, and easily causes problems such as poor engagement and poor alignment with the housing 11 after the terminal 12 or terminal 13 is embedded. Moreover, the too long and serpentine terminal 12 or terminal 13 is difficult to be fixed in an assembling manner.

In addition, the terminal 12 or terminal 13 must be sufficiently large, thus the terminal 12 or terminal 13 has enough strength to be assembled or embedded in the housing. However, assembling or embedding the terminal 12 or terminal 13 in the housing makes a volume of the housing 11 become larger, which does not facilitate compactness of the hearing device. Thus, further improvements in a hearing aid connector would be appreciated by certain individuals.

SUMMARY OF THE PRESENT APPLICATION

The present application provides an electrical connector, which includes a housing with two fixing grooves; a pair of terminals corresponding to the two fixing grooves, each terminal comprises a base, an extending piece extending from the base and a resilient arm extending from the base. The base includes a fixed portion, the fixed portion and the corresponding fixing groove form an interference fit, the extending piece comprises a first contact portion, the resilient arm comprises a second contact portion for electrically connecting an electronic device; and two first conductive traces corresponding to the pair of terminals, an end portion of the each first conductive trace is electrically connected to the first contact portion of the corresponding terminal, and the other end portion of each of the first conductive trace can be electrically connected to a circuit board.

DESCRIPTION OF THE PREFERRED EMBODIMENTS

Hereinafter embodiments of the present application will be described in details in combination with the drawings. The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

The electrical connector depicted and discussed herein can use conductive traces to replace a portion of the terminal in the prior art, thus the terminal of the electrical connector can have simple structure and is easily manufactured. In addition, the conductive trace formed on the surface of the housing replaces the portion of the terminal assembled or embedded in the housing in the prior art, thereby reducing the volume of the housing and facilitating application of the electrical connector in a thin device.

Figure 3:
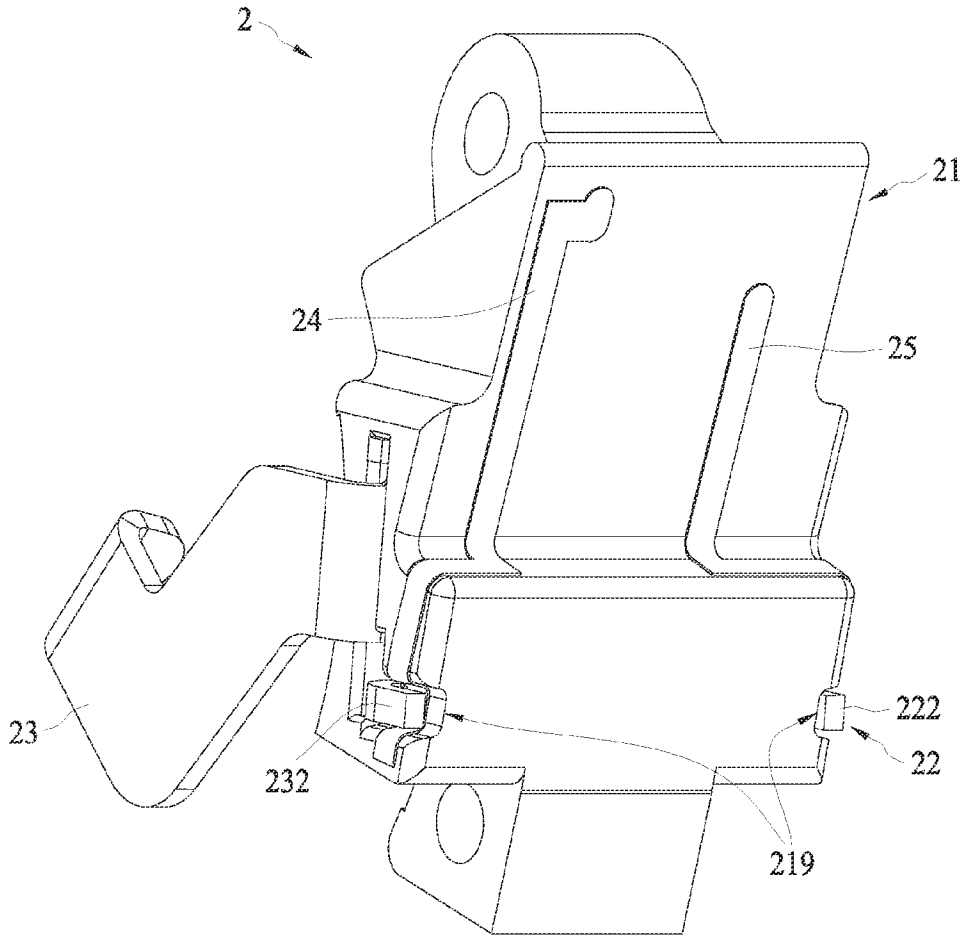
FIG. 3 is another perspective view of the electrical connector of the embodiment of the present application.
Figure 4:
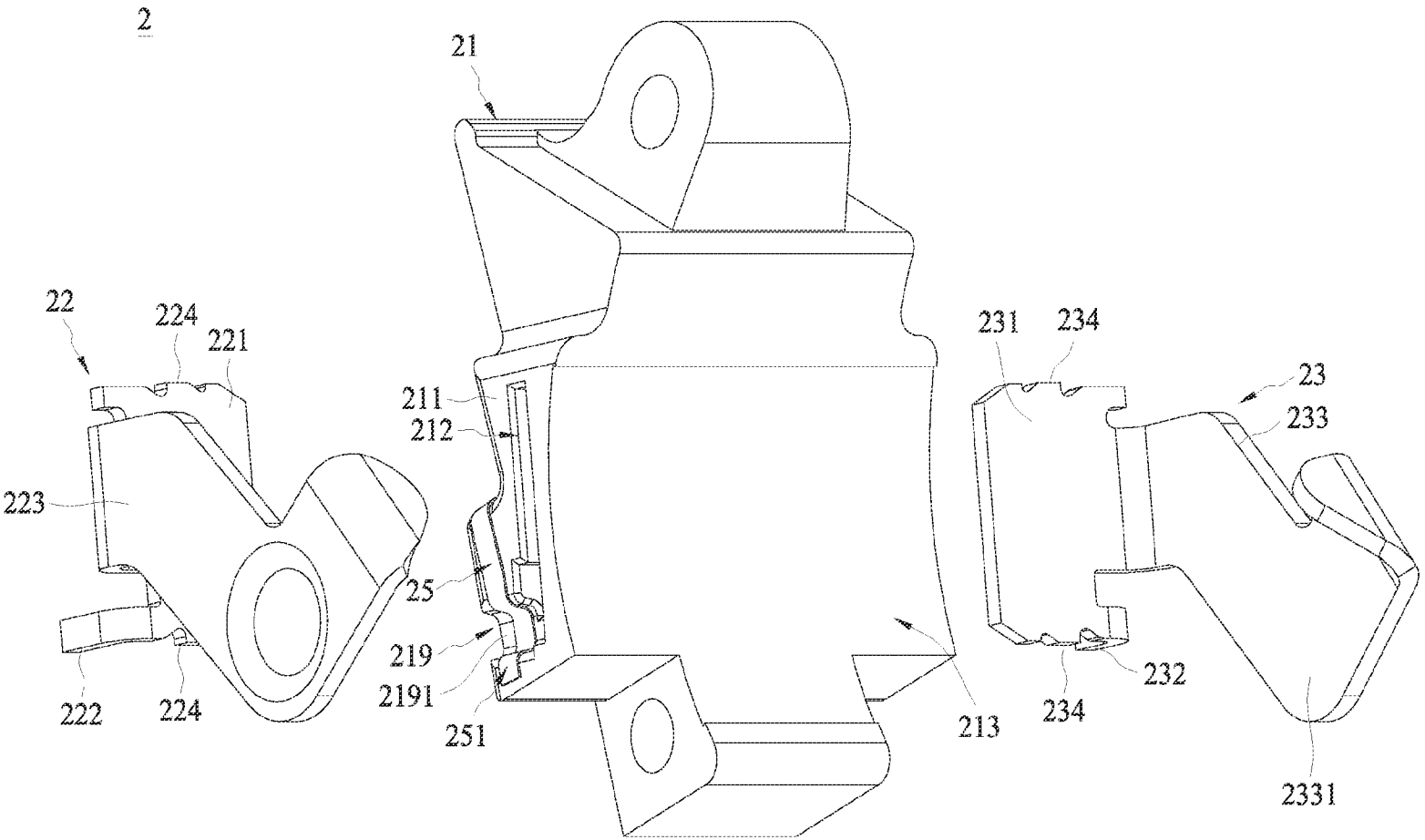
FIG. 4 is an exploded perspective view of the electrical connector of the embodiment of the present application.
Figure 5:
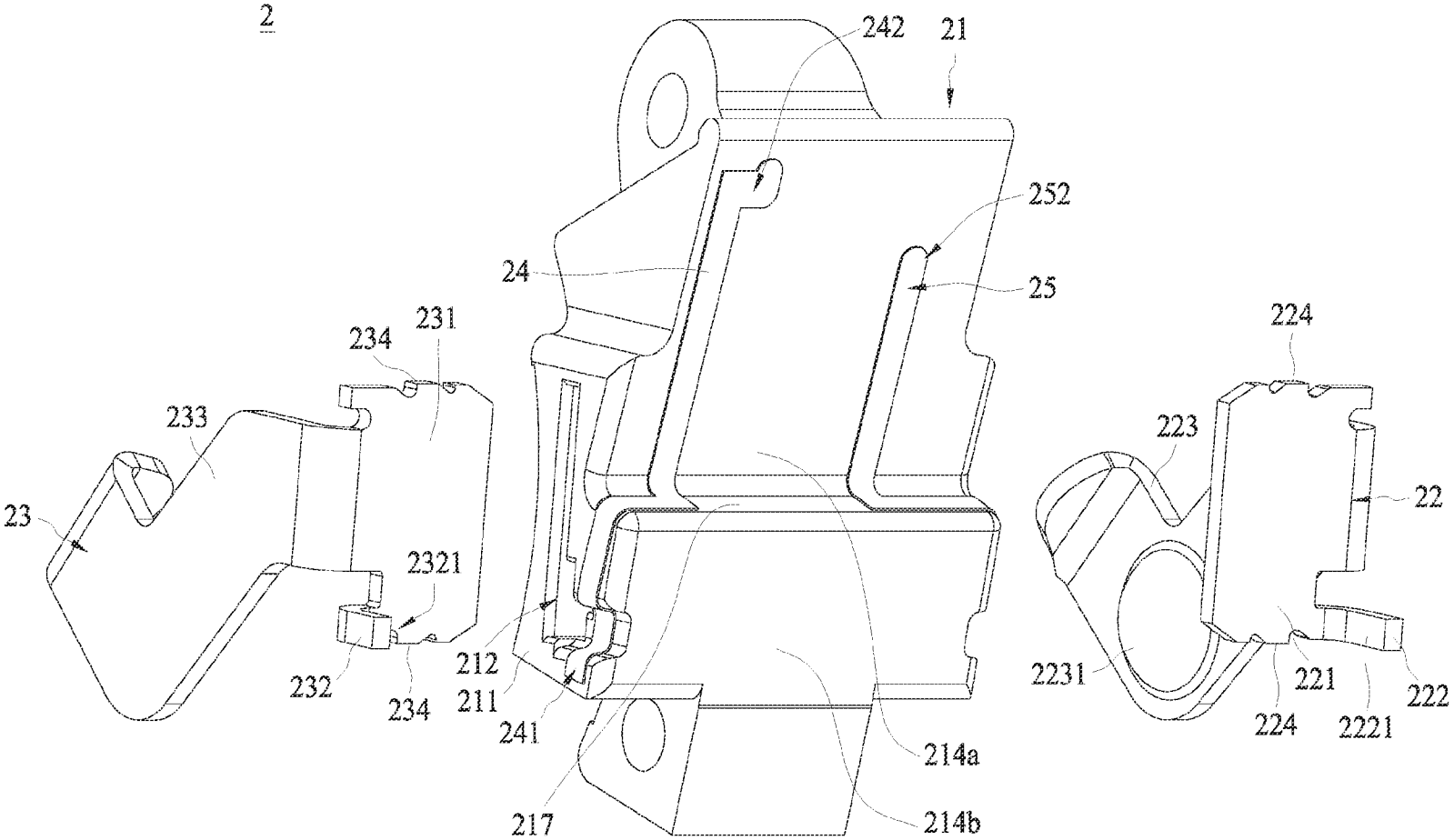
FIG. 5 is another exploded perspective view of the electrical connector of the embodiment of the present application.

As noted above, FIGS. 2 and 3 are perspective views of an electrical connector 2 provided on a circuit board 3 and FIGS. 4 and 5 are exploded perspective views of the electrical connector 2 of the embodiment of the present application. Fig. Referring to FIGS. 2-5, an electrical connector 2 comprises a housing 21 (formed of an insulative material), a pair of terminals 22, 23 (which can be formed of convention metal alloys), and two first conductive traces 24, 25. The terminals 22, 23 are fixed to the housing 21. The two first conductive traces 24, 25 correspond to the pair of terminals 22, 23. The two first conductive traces 24, 25 are formed on the housing 21, and an end portion of the each first conductive trace 24 or first conductive trace 25 is electrically connected to the corresponding terminal 22 or terminal 23, and the other end portion of the first conductive trace 24 or first conductive trace 25 is formed for an external electrical connection.

Referring to FIG. 4 and FIG. 5, the housing 21 has two opposite side faces 211 and two fixing grooves 212 which are respectively formed in the two side faces 211. In addition, the housing 21 may further comprise an arc-shaped front surface 213, a stepped face 214*a* and a stepped face 214*b*, the stepped face 214*a* and the stepped face 214*b* are formed on a surface opposite to the front surface 213.

Figure 6:
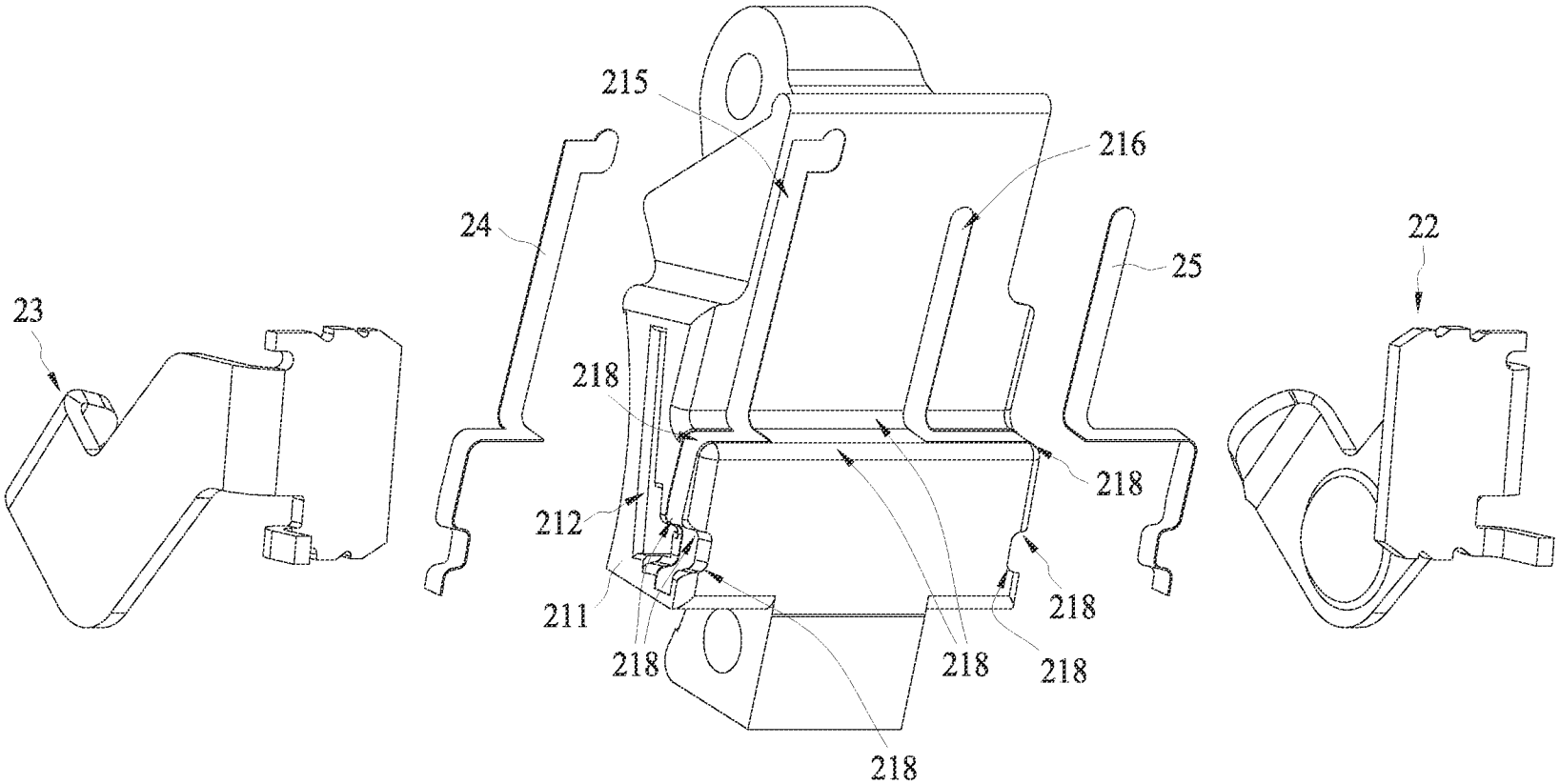
FIG. 6 is a perspective view of the embodiment of the present application illustrating the exploded terminal, conductive trace and housing.

Referring to FIG. 5 and FIG. 6, the two first conductive traces 24, 25 are formed along a surface or a geometrical contour of the housing 21. In an embodiment, the two first conductive traces 24, 25 may be manufactured by a technology of molded interconnect device. In an embodiment, the first conductive trace 24 or first conductive trace 25 comprises a metal plating layer.

Preferably, the housing 21 is made from a mixture of a high polymer material and a metal additive which is sensitive to laser. The metal additive may be a metal complex or an organic metal complex. A pattern for manufacturing the two first conductive traces 24, 25 is formed by laser on the surface of the housing 21. The surface is irradiated and etched by laser to form two shallow grooves 215, 216. Bottom faces of the shallow grooves 215, 216 are rough surfaces, and as known, the metal additive is activated by the laser, which causes a physicochemical reaction and generates metal particles embedded in the rough bottom surfaces. These metal particles may then be used as metal nuclei in a subsequent metal deposition process. Consequentially, after the pattern is formed by laser, the housing 21 may be placed in a plating bath so as to plate a laser direct structuring metal layer as the first conductive traces 24, 25 respectively on the two shallow grooves 215, 216.

Figure 1:
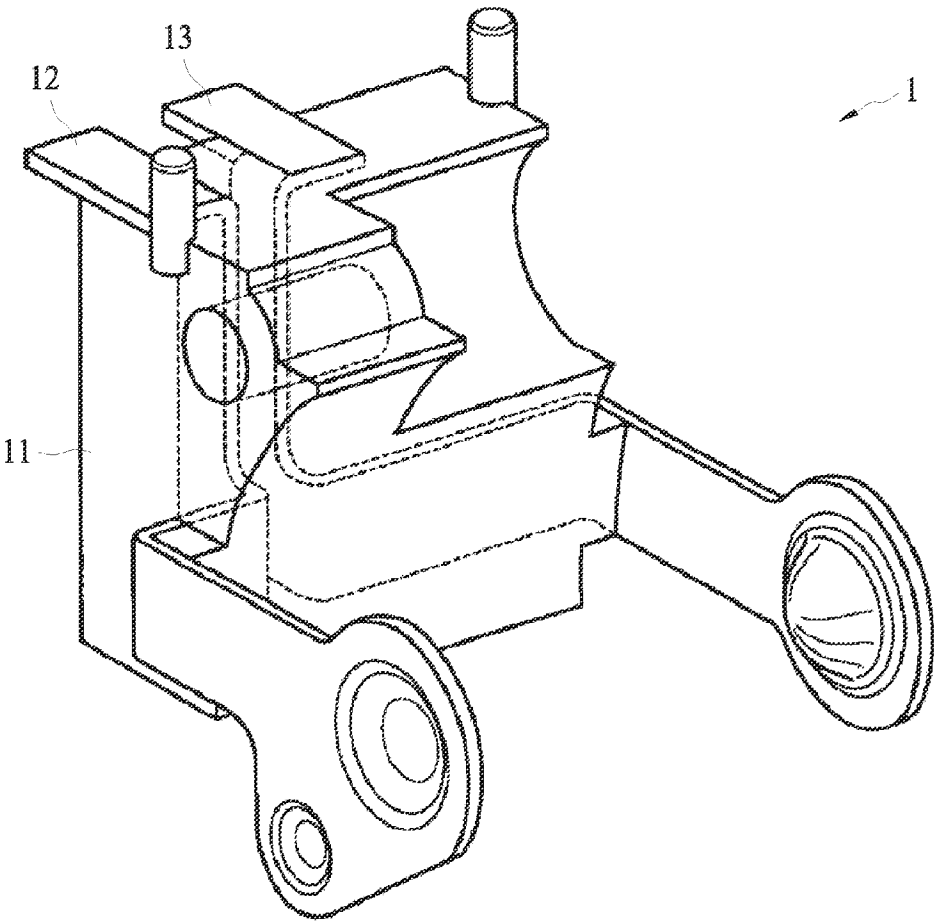
FIG. 1 (Prior Art)
FIG. 1 is a battery connector in the prior art.
Figure 2:
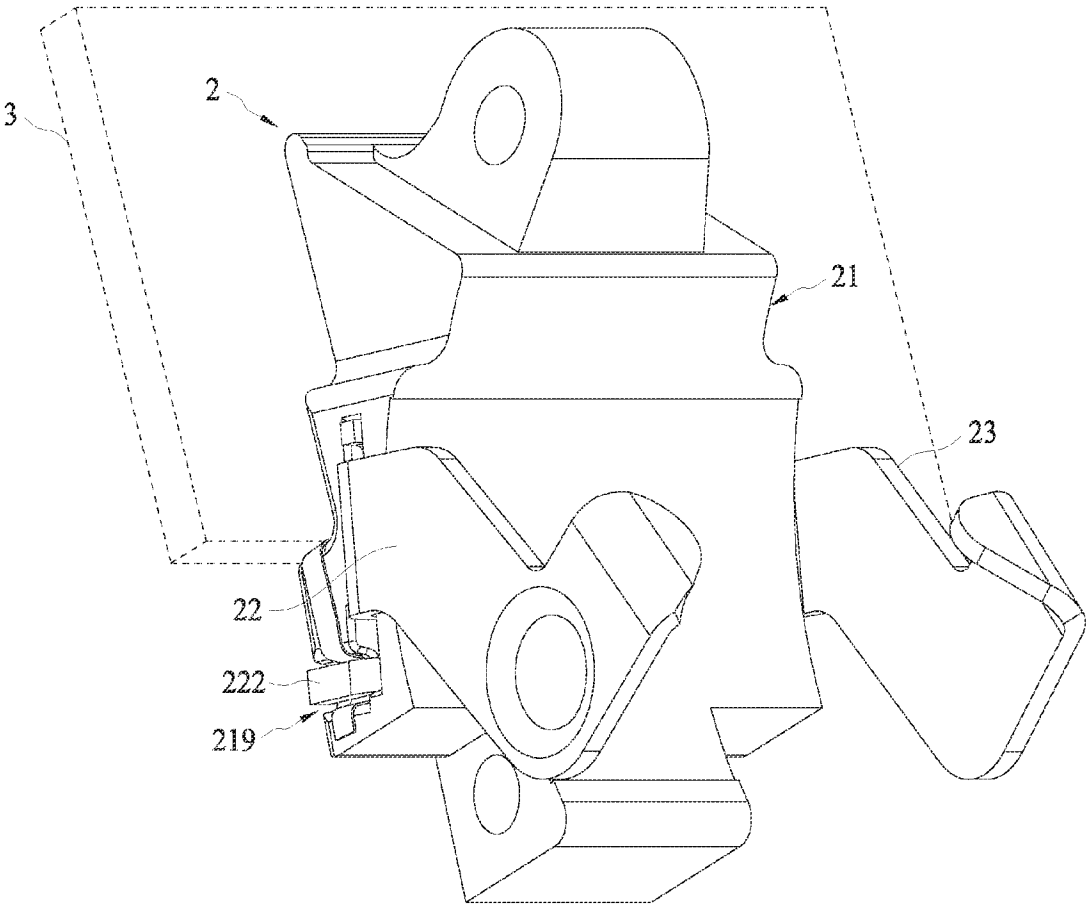
FIG. 2 is a perspective view of an electrical connector provided on a circuit board of an embodiment of the present application.

Referring to FIG. 5, the housing 21 may further comprise a connection face 217 which connects the lower stepped face 214*a* and the higher stepped face 214*b*. Both of the two first conductive traces 24, 25 have partial traces extending on the connection face 217. Specifically, an end portion 241 of the first conductive trace 24 is formed on the side face 211 of the housing 21, the first conductive trace 24 extends from the end portion 241, passes through the connection face 217 and extends to the lower stepped face 214*a*, and forms the other end portion 242 of the first conductive trace 24 on the lower stepped face 214*a*. Similarly, as shown in FIG. 4 and FIG. 5, an end portion 251 of the first conductive trace 25 is formed on the side face 211 of the housing 21, the first conductive trace 25 extends from the end portion 251, passes through the connection face 217 and extends to the lower stepped face 214*a*, and forms the other end portion 252 of the first conductive trace 25 on the lower stepped face 214*a*. The other end portions 242, 252 of the first conductive traces 24, 25 may be electrically connected to a circuit board 3 (as shown in FIG. 2). In an embodiment, the other end portions 242, 252 of the first conductive traces 24, 25 may be electrically connected to the circuit board 3 by using a surface mount technology. The housing 21 has the lower stepped face 214*a* and the higher stepped face 214*b*, the electrical connector 2 may have lower profile when the housing 21 is mounted on the circuit board 3 by using the lower stepped face 214*a*, so as to meet requirements for lightweight and thin design.

Referring to FIG. 6, an edge 218 of the housing 21 through which the each first conductive trace 24 or first conductive trace 25 passes is a round edge, thus a thickness of the bent portion of the each first conductive trace 24 or first conductive trace 25 formed at the edge 218 may be identical with a thickness of other portion of the first conductive trace 24 or first conductive trace 25, and has low risk of fracturing. A shape of this round edge is not limited to a portion of a circle, and the round edge can be other bent shapes.

Referring to FIG. 4 and FIG. 5, the pair of terminals 22, 23 correspond to the two the fixing grooves 212. The terminal 22 or terminal 23 comprises a base 221 or base 231, an extending piece 222 or extending piece 232, and a resilient arm 223 or resilient arm 233. The extending piece 222 or extending piece 232 extends from the base 221 or base 231, the resilient arm 223 or resilient arm 233 extends from the base 221 or base 231, the extending piece 222 or extending piece 232 and the resilient arm 223 or resilient arm 233 can be bent in the opposite direction.

The base 221 or base 231 comprises a fixed portion 224, 234, the fixed portion 224, 234 is formed for interference fit with the corresponding fixing groove 212.

The extending piece 222 or extending piece 232 comprises a first contact portion 2221 or first contact portion 2321, the extending piece 222 or extending piece 232 after bending may be electrically connected to the end portion 241 or end portion 251 of the corresponding first conductive trace 24 or first conductive trace 25. In an embodiment, after the extending piece 222 or extending piece 232 is bent, the first contact portion 2221 or first contact portion 2321 is pressed fit with the end portion 241 or end portion 251 of the corresponding first conductive trace 24 or first conductive trace 25. In an embodiment, after the extending piece 222 or extending piece 232 is bent, the first contact portion 2221 or first contact portion 2321 is soldered to the end portion 241 or end portion 251 of the corresponding first conductive trace 24 or first conductive trace 25. In an embodiment, after the extending piece 222 or extending piece 232 is bent, the first contact portion 2221 or first contact portion 2321 is fixed to the end portion 241 or end portion 251 of the first conductive trace 24 or first conductive trace 25 by using a conductive adhesive.

The extending piece 222 or extending piece 232 of the terminal 22 or terminal 23 is electrically connected to the corresponding first conductive trace 24 or first conductive trace 25, so that the terminal 22 or terminal 23 may be electrically connected to an electronic device (not shown) via the corresponding first conductive trace 24 or first conductive trace 25. In other words, the first conductive trace 24 or first conductive trace 25 replaces a portion of the too long and serpentine terminal in the prior art, so as to allow the terminal 22 or terminal 23 to be shorter and have a simple structure, therefore, the terminal 22 or terminal 23 is easily manufactured, and time and labor are saved in manufacturing. Moreover, the base 221 or base 231 of the terminal 22 or terminal 23 is simply and directly assembled into the fixing groove 212, and thus the assembling is completed, the assembling of the terminal 22 or terminal 23 is easy and the alignment of the terminal 22 or terminal 23 is accurate. In addition, the first conductive trace 24 or first conductive trace 25 replaces the portion of the terminal assembled or embedded in the housing in the prior art, and the first conductive trace 24 or first conductive trace 25 is formed on the surface of the housing 21, therefore the volume of the housing 21 may be small, the small housing 21 may allow the volume of the electrical connector 2 to be small, so as to be suitable for lightweight and thin products.

As shown in FIG. 2 and FIG. 3, in an embodiment, the housing 21 may further comprise two recessed grooves 219, the two recessed grooves 219 are provided corresponding to the extending piece 222 or extending piece 232 of the terminal 22 or terminal 23, so as to allow the extending piece 222 or extending piece 232 to extend in the corresponding recessed groove 219. The provision of the recessed groove 219 not only facilitates alignment of the extending piece 222 or extending piece 232 while mounting, but also may receive the extending piece 222 or extending piece 232 to allow the extending piece 222 or extending piece 232 not exposed, so as to avoid increase of the volume of the electrical connector 2, and avoid collision to the extending piece 222 or extending piece 232 which causes the electrical connection between the extending piece 222 or extending piece 232 and the corresponding first conductive trace 24 or first conductive trace 25 to be not reliable. In an embodiment, as shown in FIG. 4, the each first conductive trace 24 or first conductive trace 25 may extend on a bottom face 2191 of the corresponding recessed groove 219, and the each extending piece 222 or extending piece 232 contacts the portion of the first conductive trace 24 or first conductive trace 25 which extends on the bottom face 2191 of the recessed groove 219, but the present application is not limited to that.

As shown in FIG. 4 and FIG. 5, the resilient arm 223 or resilient arm 233 comprises a second contact portion 2231 or second contact portion 2331, the second contact portion 2231 or second contact portion 2331 is used for electrically connecting an electronic device. In an embodiment, the second contact portions 2231, 2331 are used for clamping an electronic device. In an embodiment, the second contact portions 2231, 2331 are used for clamping a battery.

Figure 7:
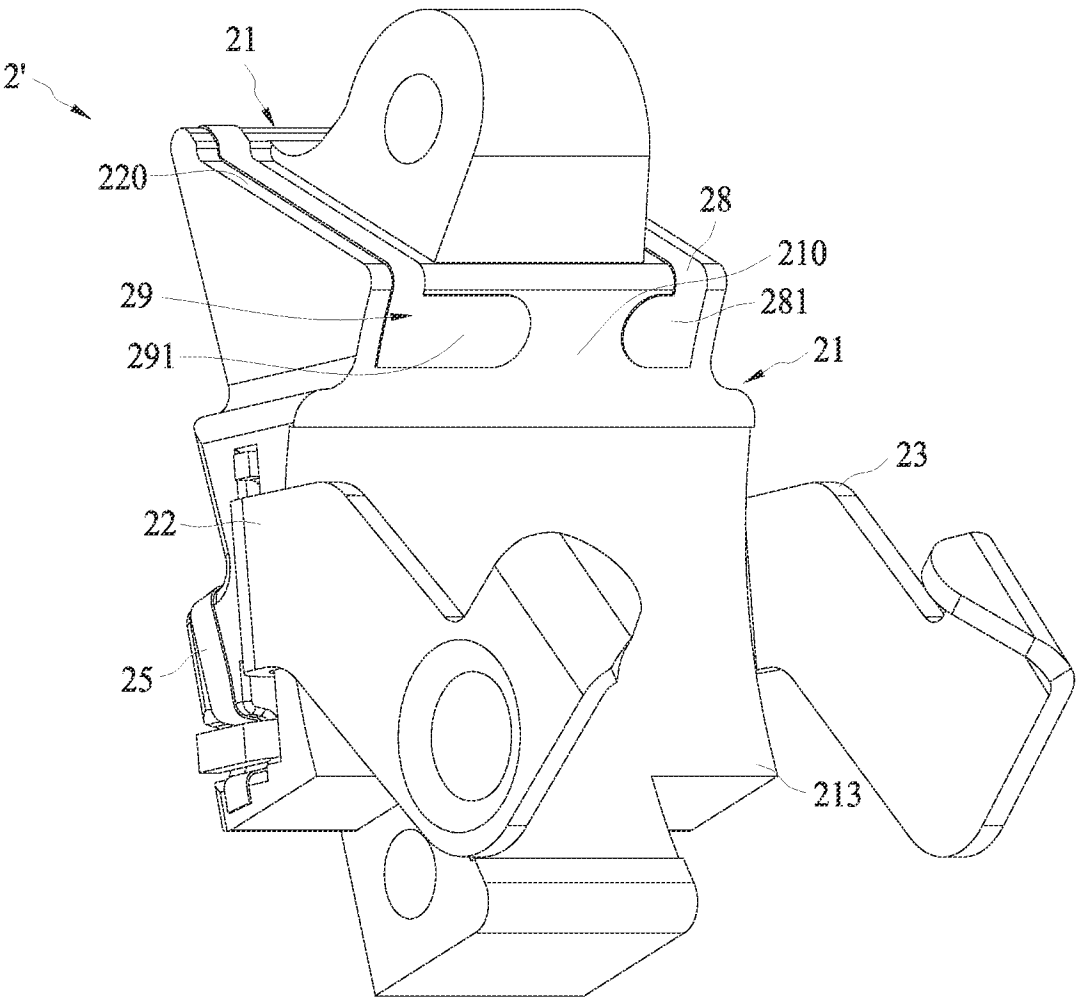
FIG. 7 is a perspective view of the electrical connector of another embodiment of the present application.
Figure 8:
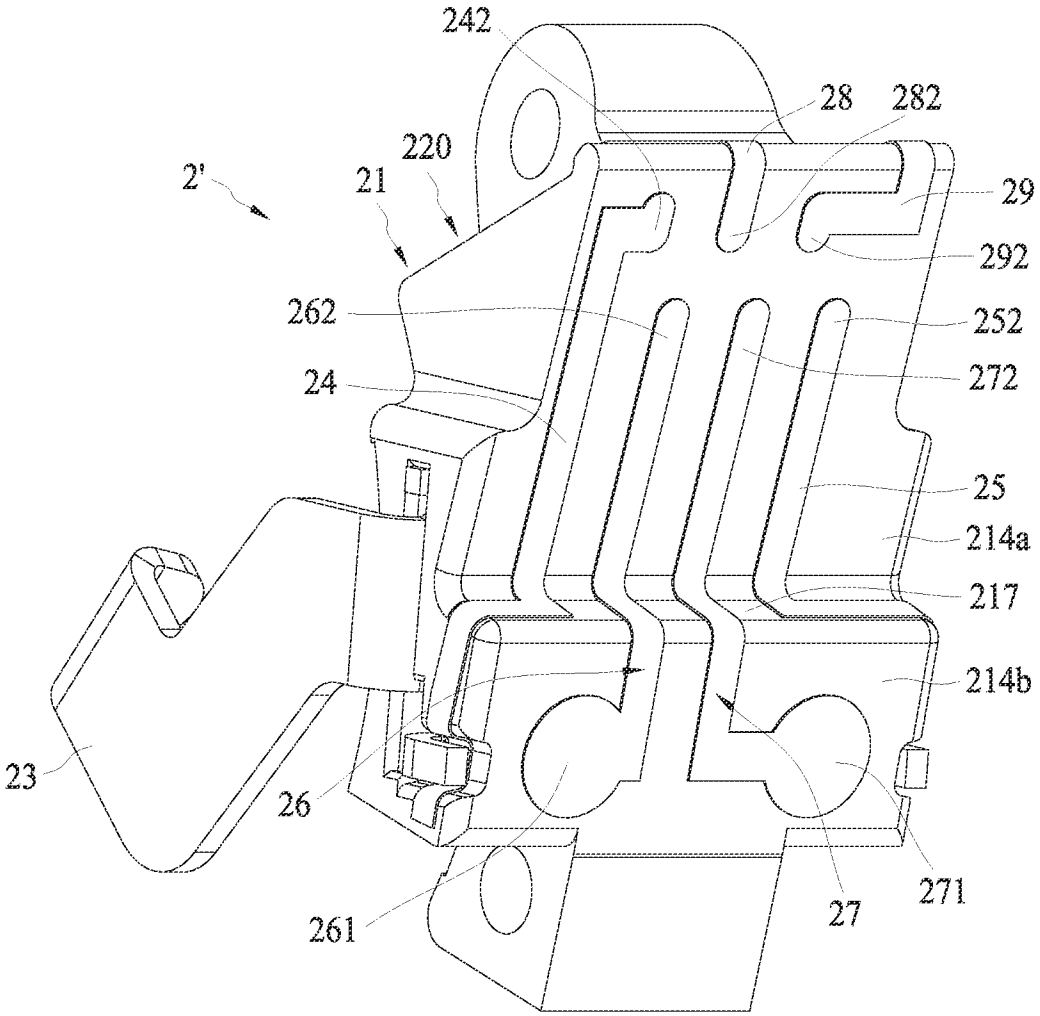
FIG. 8 is another perspective view of the electrical connector of another embodiment of the present application.

FIG. 7 is a perspective view of the electrical connector 2' of another embodiment of the present application. FIG. 8 is another perspective view of the electrical connector 2' of another embodiment of the present application. Referring to FIG. 2, FIG. 7 and FIG. 8, the electrical connector 2' is similar to the electrical connector 2, the main difference is that other conductive traces are formed on the housing 21 of the electrical connector 2'.

In an embodiment, the electrical connector 2' comprises second conductive traces 26, 27, wherein the second conductive traces 26, 27 extend on the lower stepped face 214*a*, the higher stepped face 214*b* and the connection face 217. An end portion 262 or end portion 272 of the each second conductive trace 26 or second conductive trace 27 extends to be adjacent to the end portions 242, 252 of the first conductive traces 24, 25 for electrically connecting the circuit board 3; and the other end portion 261 or end portion 271 of the each second conductive trace 26 or second conductive trace 27 is formed on the higher stepped face 214*b* for electrically connecting another electronic device (not shown). The other end portion 261 or end portion 271 may comprise a round connection pad.

In an embodiment, the housing 21 has a front surface 210 and an end face 220. The front surface 210 is between the end face 220 and the front surface 213, and the end face 220 is between the front surface 210 and the lower stepped face 214*a*. The electrical connector 2' may further comprise a third conductive trace 28 or third conductive trace 29, the third conductive trace 28 or third conductive trace 29 extends on the front surface 210, the end face 220 and the lower stepped face 214*a*. An end portion 281 or end portion 291 of the third conductive trace 28 or third conductive trace 29 extends onto the front surface 210 for electrically connecting another electronic device (not shown), and the other end portion 282 or end portion 292 is positioned on the lower stepped face 214*a* near the end portions 242, 252 of the first conductive trace 24, 25 for electrically connecting the circuit board 3. In another embodiment, the end portion 242 or end portion 252 of the first conductive trace 24 or first conductive trace 25, the end portion 262 or end portion 272 of the second conductive trace 26 or second conductive trace 27 or the end portion 282 or end portion 292 of the third conductive trace 28 or third conductive trace 29 may be fixed on the circuit board together by using the surface mount technology.

As can be appreciated, therefore, the electrical connector as depicted includes the housing, the terminal and the conductive trace. An end portion of the conductive trace may be connected to the electronic device or the circuit board. The terminal is connected to the electronic device or the circuit board via the conductive trace, thus the terminal can be shorter and has simple structure, which improves manufacturing. The conductive trace replaces the portion of the terminal assembled or embedded in the housing in the prior art, and the conductive trace is formed on the surface of the housing to reduce the volume of the housing, so as to facilitate application of the electrical connector in thin type devices.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. An electrical connector, comprising:

a housing including two fixing grooves;

a pair of terminals, each terminal respectively positioned in one of the two fixing grooves, the each terminal comprising a base, an extending piece extending from the base and a resilient arm extending from the base, the base including a fixed portion, wherein the fixed portion and the corresponding fixing groove forming an interference fit, the extending piece including a first contact portion and the resilient arm including a second contact portion for electrically connecting an electronic device; and two first conductive traces corresponding to the pair of terminals, an end portion of the each first conductive trace being electrically connected to the first contact portion of the corresponding terminal, and the other end portion of the each first conductive trace being configured to be electrically connected to a circuit board.

2. The electrical connector according to claim 1, wherein the each first conductive trace comprises a metal plating layer formed by laser direct structuring.

3. The electrical connector according to claim 1, wherein the housing comprises two shallow grooves and each of the first conductive trace is formed on the corresponding shallow groove.

4. The electrical connector according to claim 1, wherein the housing comprises two recessed grooves, the extending piece of the each terminal extends in the corresponding recessed groove.

5. The electrical connector according to claim 4, wherein the each first conductive trace extends on a bottom face of the corresponding recessed groove and each extending piece contacts the portion of the first conductive trace which extends on the bottom face of the recessed groove.

6. The electrical connector according to claim 1, wherein electrical connection between the first contact portion of the each terminal and the end portion of the corresponding first conductive trace is by press fit, soldering or fixing with conductive adhesive.

7. The electrical connector according to claim 1, wherein the second contact portions of the pair of terminals are used for clamping the electronic device.

8. The electrical connector according to claim 7, wherein the second contact portions of the pair of terminals are used for clamping a battery as the electronic device.

9. The electrical connector according to claim 1, wherein the housing comprises a higher stepped face and a lower stepped face and the other end portions of the two first conductive traces are positioned on the lower stepped face.

10. The electrical connector according to claim 9, further comprising a second conductive trace, an end portion of the second conductive trace extending to be adjacent to the other end portions of the two first conductive traces and configured to electrically connect to the circuit board and the other end portion of the second conductive trace being formed on the higher stepped face for electrically connecting another electronic device.

11. The electrical connector according to claim 9, wherein the housing comprises a front surface and an end face, the end face extends between the front surface and the lower stepped face, the electrical connector further comprises a third conductive trace, the third conductive trace extending on the end face, an end portion of the third conductive trace extending to the front surface for electrically connecting another electronic device and the other end portion of the third conductive trace extends to be adjacent to the other end portion of the two first conductive traces and configured to be electrically connected to the circuit board.

12. The electrical connector according to claim 1, wherein the housing has a round edge and each of the first conductive traces passes the round edge.

* * * * *